US005718655A

United States Patent [19]

Phillips

[11] Patent Number: 5,718,655

[45] Date of Patent: Feb. 17, 1998

[54] THERAPEUTIC RESILIENT HAND EXERCISER AND METHOD OF MANUFACTURE

[75] Inventor: Lester Phillips, Houston, Tex.

[73] Assignee: Gayla Industries, Inc., Houston, Tex.

[21] Appl. No.: 678,660

[22] Filed: Jul. 11, 1996

[51] Int. Cl.[6] ..... A63B 23/16

[52] U.S. Cl. ..... 482/49; 273/584

[58] Field of Search ..... 482/44, 49; 446/267, 446/369; 273/63 E, 58 F, 584

[56] References Cited

U.S. PATENT DOCUMENTS

| | | | |
|---|---|---|---|
| 3,347,545 | 10/1967 | Nichols | 446/267 |
| 3,601,923 | 8/1971 | Rosenberg | 446/267 |
| 3,734,498 | 5/1973 | Seiersen | 273/63 E |
| 4,952,190 | 8/1990 | Tarnoff et all. | 446/267 |
| 5,350,342 | 9/1994 | Scatterday | 482/49 |

*Primary Examiner*—Stephen R. Crow
*Attorney, Agent, or Firm*—Kenneth A. Roddy

[57] ABSTRACT

A therapeutic resilient hand exerciser and method of manufacture is disclosed. A mass of tiny glass spheres having the consistency and appearance of a fine powder is enclosed in a resilient inner bladder which is surrounded by an outer resilient bladder and a thin layer of powder is disposed between the exterior surface of the inner bladder and interior surface of the outer bladder to prevent the surfaces from sticking together and allow relative sliding movement therebetween. The tiny spheres roll on each other upon squeezing and releasing pressure on the exerciser to provide low resistance to relative movement and allow the exerciser to be compressed quickly and to resume its natural shape quickly due to the resiliency of the superposed bladders, and thereby produces a smooth squishy sensation.

5 Claims, 2 Drawing Sheets

THERAPEUTIC RESILIENT HAND EXERCISER AND METHOD OF MANUFACTURE

BACKGROUND OF THE INVENTION

1. Field of the Invention

This invention relates generally to resilient and pliable hand exercisers and methods of manufacture, and more particularly to a therapeutic resilient hand exerciser which fits into the palm of the hand contains a mass of tiny glass spheres having the consistency and appearance of a fine powder enclosed in a resilient double ply bladder with a thin layer of powder disposed between the plies of the bladders.

2. Brief Description of the Prior Art

Therapeutic hand exercisers are know in the art. There are several commercially available resilient hand exercisers which fit into the palm of the hand.

A resilient rubber hand exerciser known as the "Eggserciser" (TM) is sold by Eggstra Enterprises, Inc., of Alabaster, Ala. This device is an egg-shaped member molded of homogeneous foam rubber.

A pliable hand exerciser sold by Qualatex of Wichita, Kans. under the name "Ad Impressions" (TM) ASI 78200 is a natural latex balloon filled with hard granular particles having the consistency of sand. The neck of the balloon is tied in a knot. This device has only a single layer of natural latex and the filler material particles are irregular shaped many faceted particles with flat surfaces and sharp edges and range in particle size from about 1/32" to about 3/64". The Qualatex device is firm and hard, has a "crunching" feel when squeezed, has very poor resiliency, and substantially retains a distorted shape after being squeezed.

Therapeutic hand exercisers known as the "Gripp" (TM) and "Thera-Gripp" (TM) are sold by Abilitations of Atlanta Ga. These devices resemble a small ball in their natural state and are filled with a material which appears to be yellow seeds or grain, similar to wheat or oats, permanently encased in two layers of natural latex. The filler material particles are oval-shaped with two flat sides, approx. 3/32" in length and 1/32" thick. These devices are relatively firm and hard, have a "crunching" feel when squeezed, and have poor resiliency.

Most prior art hand exercisers utilize a single or double layer resilient outer covering or bladder filled with sand, seed, grain, or other "granular" or crystallized particles which have flat surfaces and/or sharp points. The sharp surfaces or points of the "granular" or crystallized filler material will abrade the interior surface of the resilient bladder and cause premature wear resulting in short product life, and leakage of the filler material.

Prior art hand exercisers which utilize irregular shaped particles having facets or flat surfaces, when squeezed in the hand, produce a "crunching" action due to the relative movement between the irregular shaped particle surfaces as they are compressed and displaced. This also makes the prior art exercisers harder to squeeze, or more resistant to squeezing. When the squeezing pressure is released, the prior art devices hold their distorted shape for a period of time until the resiliency of the bladder forces the irregular shaped particles to move relative to one another as the device slowly resumes its natural shape. Those prior art devices which utilize a single layer of resilient latex are particularly non-resiliently responsive and tend to be only pliable, rather than resilient, and substantially retain the distorted configuration after being squeezed.

The present invention is distinguished over the prior art in general by a therapeutic resilient hand exerciser which has a mass of tiny glass spheres having the consistency and appearance of a fine powder enclosed in a resilient inner bladder which is surrounded by an outer resilient bladder and a thin layer of powder disposed between the exterior surface of the inner bladder and interior surface of the outer bladder to prevent the surfaces from sticking together and allow relative sliding movement therebetween. The tiny spheres roll on each other upon squeezing and releasing pressure on the exerciser to provide low resistance to relative movement and allow the exerciser to be compressed quickly and to resume its natural shape quickly due to the resiliency of the superposed bladders, and thereby produces a smooth squishy sensation.

The present exerciser is a significant improvement over the prior art. The double bladder provides a resilient double ply wall which gives the product resiliency, flexibility, compressibility, and strength without excessive wall thickness. The thin powder layer between the double ply resilient walls prevents the walls from sticking together and allows the plies of resilient material to slide relative to one another when compressed. This feature prevents wear or friction between the walls and extends the life of the product. Unlike prior art therapeutic hand exercisers filled with sand, seed, grain, or other "granular" or crystallized material which have flat surfaces and/or sharp points, the powder-like tiny glass spheres used in the present invention have no flat surfaces or sharp points. Thus, the filler material is substantially nonabrasive and significantly reduces or eliminates the problem of the filler material abrading the resilient bladder material, and also extends the life of the product.

Unlike prior art therapeutic hand exercisers filled with sand, seed, grain, or other "granular" or crystallized material which have flat surfaces and/or sharp points which makes them less responsive and more resistant to squeezing and tend to resume their distorted shape after the pressure is released due to the relative movement between the irregular shaped particles as they are compressed and displaced, the powder-like tiny glass spheres used in the present invention roll on each other upon squeezing and releasing pressure on the exerciser and provide low resistance to relative movement and allow the exerciser to be compressed and resume its natural shape more quickly.

Also, unlike prior art therapeutic hand exercisers filled with sand, seed, grain, or other "granular" or crystallized material which have flat surfaces and/or sharp points which, when squeezed in the hand, produce a "crunching" sensation due to the relative movement between the irregular shaped particles as they are compressed and displaced, the powder-like tiny glass spheres used in the present invention roll on each other upon squeezing and releasing pressure on the exerciser and provide low resistance to relative movement and produces a smooth "squishy" sensation.

Unlike prior art hand exercisers which are closed by tying a knot in the neck portion of the bladder, the present exerciser is sealed with a wire staple which is crimped securely around the neck portion of the superposed bladders in the manner of a sausage staple on a sausage casing, thus making it difficult to be opened by small children.

SUMMARY OF THE INVENTION

It is therefore an object of the present invention to provide a therapeutic resilient hand exerciser which fits into the palm area of the hand and is squeezed and released for exercise and therapy of the muscles of the hand, fingers, and arm.

It is another object of this invention to provide a therapeutic resilient hand exerciser which fits into the palm area of the hand and provides a relaxing feeling when squeezed and released due to its resiliently deformable nature.

Another object of this invention is to provide a therapeutic resilient hand exerciser having a double wall bladder of resilient material with a talc powder layer between the double plies of resilient material to provide resiliency, flexibility, compressibility, and strength without excessive wall thickness.

Another object of this invention is to provide a therapeutic resilient hand exerciser having a double wall bladder of resilient material with a talc powder layer between the double plies of resilient material to prevent the double plies of material from sticking together and allow the plies of resilient material to slide relative to one another when the exerciser is compressed, thus reducing wear and friction between the plies and extending the life of the product.

Another object of this invention is to provide a therapeutic resilient hand exerciser having a resilient bladder filled with tiny glass spheres having the consistency of a fine powder wherein the tiny spheres roll on each other as the exerciser is squeezed and the pressure is released and thereby providing low resistance to relative movement of the filler material and allowing the exerciser to be compressed quickly and to resume its natural shape quickly.

Another object of this invention is to provide a therapeutic resilient hand exerciser having a resilient bladder filled with tiny glass spheres having the consistency of a fine powder wherein the tiny spheres have no flat surfaces or sharp edges which would abrade the interior surface, and will significantly reduce or eliminate the problem of the filler material abrading the resilient bladder material, and significantly extend the life of the product.

A further object of this invention is to provide a therapeutic resilient hand exerciser having a resilient bladder filled with tiny glass spheres having the consistency of a fine powder wherein the tiny spheres roll on each other when the exerciser is squeezed and the pressure is released to produce a smooth squishy sensation when squeezed.

A still further object of this invention is to provide a therapeutic resilient hand exerciser which is sealed closed with a wire staple crimped securely around the neck portion of the bladder in the manner of a sausage staple on a sausage casing, thus making it difficult to be opened by small children.

Other objects of the invention will become apparent from time to time throughout the specification and claims as hereinafter related.

The above noted objects and other objects of the invention are accomplished by a therapeutic resilient hand exerciser which has a mass of tiny glass spheres having the consistency and appearance of a fine powder enclosed in a resilient inner bladder which is surrounded by an outer resilient bladder and a thin layer of powder disposed between the exterior surface of the inner bladder and interior surface of the outer bladder to prevent the surfaces from sticking together and allow relative sliding movement therebetween. The tiny spheres roll on each other upon squeezing and releasing pressure on the exerciser to provide low resistance to relative movement and allow the exerciser to be compressed quickly and to resume its natural shape quickly due to the resiliency of the superposed bladders, and thereby produces a smooth squishy sensation.

DESCRIPTION OF THE PREFERRED EMBODIMENT

Figure 1:
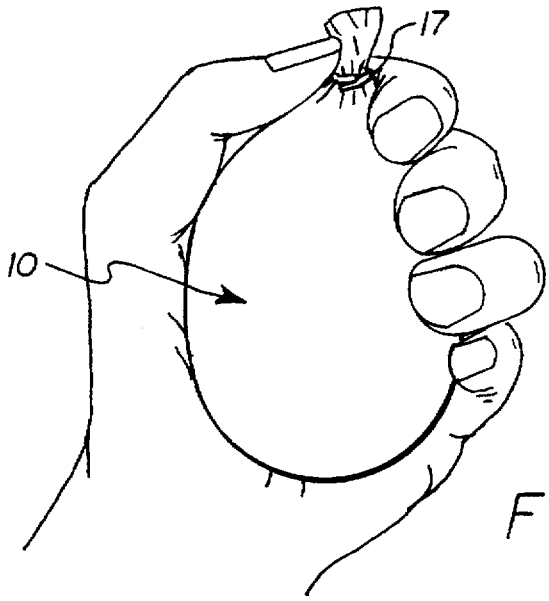
FIG. 1 is a perspective view of the therapeutic resilient hand exerciser in accordance with the present invention, shown being held in the palm of a hand.
Figure 2:
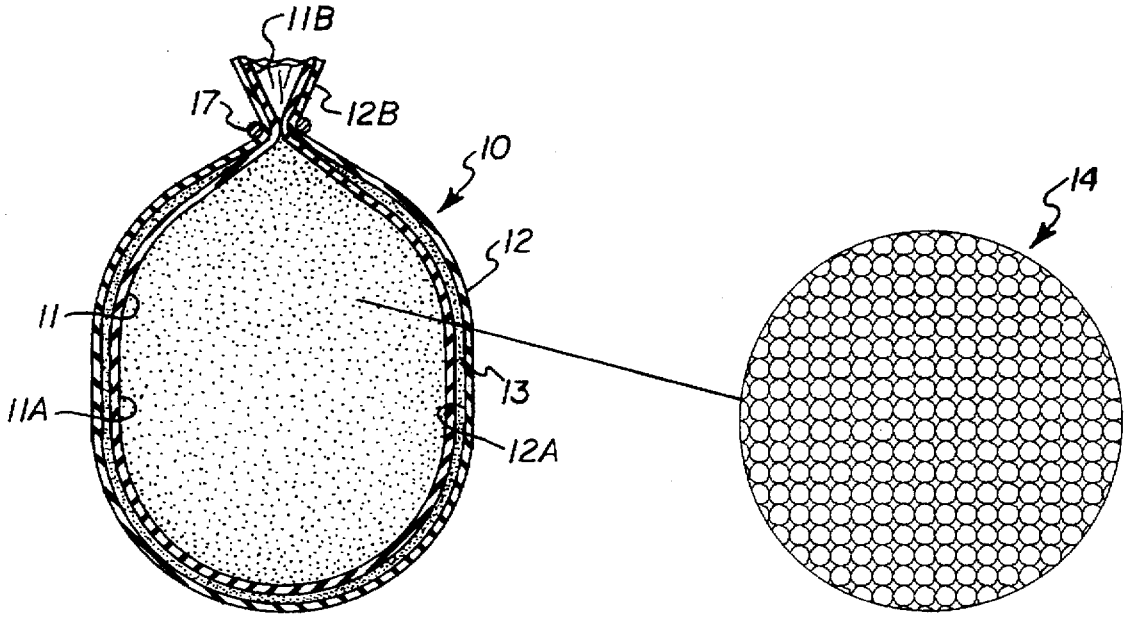
FIG. 2 is a cross sectional view of the therapeutic resilient hand exerciser.
Figure 3:
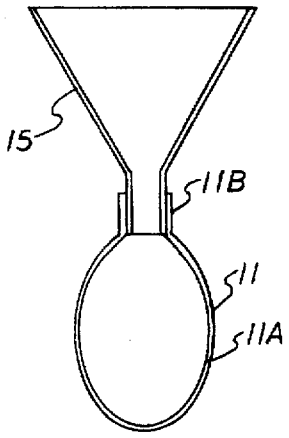
FIGS. 3 though 9 illustrate somewhat schematically, the steps in the manufacture of the therapeutic resilient hand exerciser in accordance with the present invention.

Referring to the drawings by numerals of reference, there is shown in FIGS. 1 and 2, a preferred therapeutic hand exerciser 10 in accordance with the present invention. In its natural state, as shown in FIG. 1, the exerciser 10 is a generally oval-shaped member having a diameter of approximately 2¼" and a length of approximately 2½" to fit into the palm of the hand of the user.

FIG. 2 shows the exerciser 10 in cross section at a larger scale. As seen in FIG. 2, the exerciser 10 is formed of an inner bladder 11 and an outer bladder 12 formed of resilient material such as latex rubber. Each bladder 11 and 12 has a main body portion 11A and 12A and a tubular neck portion 11B and 12B, respectively.

The inner and outer bladders 11 and 12 are superposed to provide a double layer of resilient material. A thin layer or coating of talc powder 13 is disposed between the exterior of the main body portion 11A and the interior of the main body portion 12A, to prevent friction or sticking between the superposed layers and allow relative movement therebetween.

The interior of the inner resilient bladder 11 is filled with approximately 5.6 oz. of a powder-like material 14 formed of tiny glass spheres having a particle size ranging from about 70 to about 140 mesh (U.S. standard), which equates to a particle diameter of from about 0.0083" to about 0.0041". The filler material 14 is represented schematically in the drawing figure. In reality, the filler material has the consistency and appearance of a fine white powder. The tiny glass sphere material 14 has a specific gravity of from about 2.46 g/cc to about 2.49 g/cc. The tiny glass spheres are formed of soda-lime glass, or glass oxide. A suitable glass sphere material is manufactured by Potters Industries Inc., of Carlstadt, N.J. and known commercially as "Impact Beads".

The exerciser device 10 is placed in the palm area of the hand and is squeezed and released for exercise and therapy of the muscles of the hand, fingers, and arm. The exercise device 10 provides a smooth resistance to the squeezing pressure.

The double bladders 11 and 12 provide a resilient double ply exterior wall which gives the device resiliency, flexibility, compressibility, and strength without excessive wall thickness. The layer of talc powder 13 between the double ply walls prevents the plies of resilient material from sticking together and allows the plies to slide relative to one another when the device is squeezed and released. This feature prevents wear or friction between the walls and extends the life of the product.

The powder-like filler material 14 is formed of tiny glass spheres which roll on each other as the device is squeezed and the pressure is released. Thus, the filler material 14 of the present invention has a low resistance to relative movement. This feature allows the device to be compressed quickly and to resume its natural shape quickly when the resiliency of the double wall bladder forces the device to resume its natural shape.

The combination of the resilient double ply wall with the talc powder layer between the double ply walls and the powder-like tiny glass spheres which roll on each other as the device is squeezed and released give the present invention a unique smooth squishy feeling when squeezed and released, and makes it more resiliently responsive than prior art hand exercisers filled with sand, seed, grain, or other "granular" or crystallized material which have flat surfaces and/or sharp points.

METHOD OF MANUFACTURE

Referring now to FIGS. 3–9, the method of manufacturing the therapeutic resilient hand exerciser will be described.

The bladders 11 and 12 are small bulbous balloon-like members formed of rubber, preferably latex. During the manufacture of the bladders 11 and 12, a talc powder coating is applied to their interior and exterior surfaces to prevent the rubber surfaces from sticking together. The talc powder is not shown in FIGS. 3–9.

The neck portion 11B of the first, or inner resilient bladder 11 having a talc powder coating on its interior and exterior surfaces is installed on the open bottom end of a funnel or hopper 15 (FIG. 3) and biasly retained thereon by its resiliency.

Figure 4:
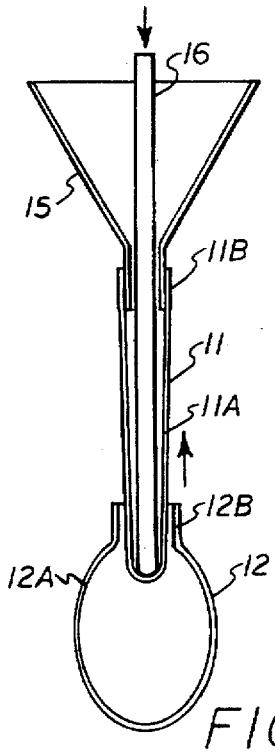

A rod or dowel 16 is inserted through the interior of the funnel or hopper 15 and into the first, or inner, resilient bladder 11 to push its bottom end downwardly and stretch the first resilient bladder longitudinally so that it becomes narrower than the interior diameter of the neck portion 12B of the second or outer bladder 12. The second or outer resilient bladder 12 having a talc powder coating on its interior and exterior surfaces is installed over the longitudinally extended first or inner resilient bladder 11 in superposed relation with its neck portion 12B surrounding and biasly engaged on the neck portion 11B of the first resilient bladder 11 (FIG. 4). After the outer bladder 12 is installed, the rod or dowel 16 is withdrawn.

Figure 5:
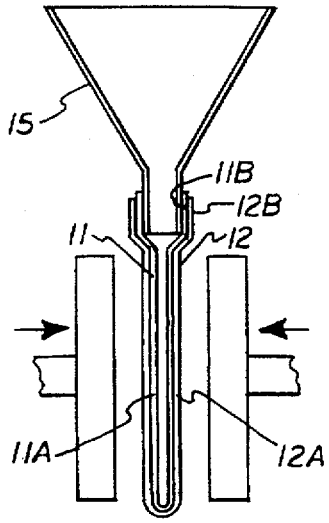

The superposed inner and outer resilient bladders 11 and 12 are then laterally pressed to drive air out of the space between the exterior of the inner resilient bladder and the interior of outer resilient bladder (FIG. 5).

Figure 6:
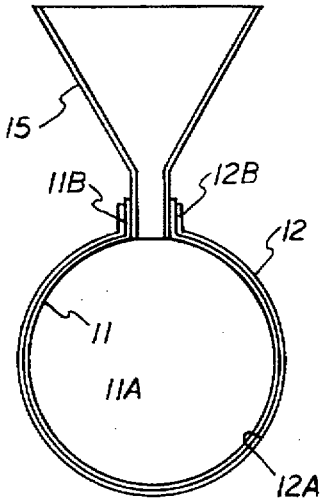

After being pressed, a volume of air is temporarily introduced into the interior of the inner resilient bladder 11 to inflate and temporarily expand the superposed body portions 11A and 12A of the inner and outer resilient bladders 11 and 12 as a unit (FIG. 6).

Figure 7:
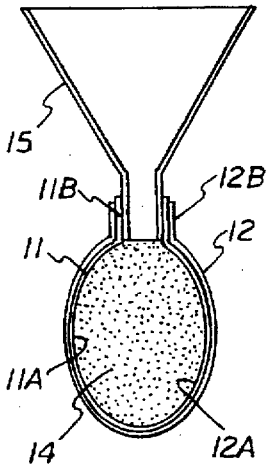

The interior of the inner resilient bladder 11 is then filled with a volume of the previously described tiny glass sphere material 14 having the consistency of fine powder to slightly expand the superposed body portions 11A and 12A of the inner and outer resilient bladders 11 and 12 (FIG. 7). In a preferred embodiment, approximately 5.6 oz. of the powder-like material 14 is used to fill the superposed bladders.

Figure 8:
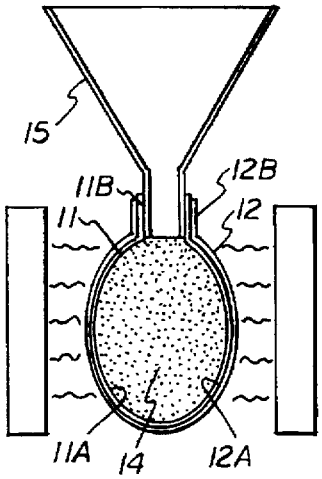

The superposed inner and outer resilient bladders 11 and 12 filled with the powder-like tiny glass sphere material 14 is then passed through a heat tunnel and subjected to hot air to radially shrink the superposed layers around the mass of powder-like tiny glass sphere material 14, and remove air from the powder-like mass and from between the superposed layers of resilient material (FIG. 8).

The superposed neck portions 11A and 12A of the inner and outer resilient bladders 11 and 12 are removed from the bottom end of the funnel or hopper 15, and inserted into a pneumatic stapling machine.

Figure 9:
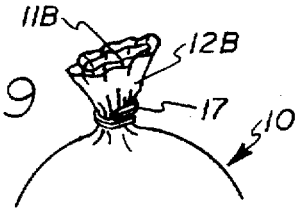

The stapling machine is actuated to secure a wire staple 17 transversely around the superposed neck portions 11B and 12B to seal the open end of the bladders (FIG. 9). It should be noted that wire staple 17 does not penetrate the resilient material, but is crimped around the neck portions 11B and 12B in the manner of a sausage staple on a sausage casing.

The sealed exercise device is then cleaned and dried to remove any powder-like tiny glass spheres from the exterior thereof.

While this invention has been described fully and completely with special emphasis upon a preferred embodiment, it should be understood that within the scope of the appended claims the invention may be practiced otherwise than as specifically described herein.

I claim:

1. A therapeutic resilient hand exerciser comprising:

a mass of of tiny spheres having a particle size of from about 70 to about 140 U.S. standard mesh (about 0.0083" dia. to about 0.0041" dia.) having the consistency and appearance of fine powder;

an inner bladder formed of resilient material surrounding said mass of tiny spheres;

an outer bladder formed of resilient material superposed on said inner bladder; and a thin layer of powder disposed between an exterior surface of said inner bladder and an interior surface of said outer bladder to prevent said surfaces from sticking together and allow relative sliding movement between said inner and outer bladder surfaces; wherein said tiny spheres provide low resistance to relative movement by rolling on each other upon squeezing and releasing pressure on said exerciser, said thin layer of powder providing low friction between said inner and outer bladder surfaces, and the resiliency of said superposed bladders all working in combination allow said exerciser to be compressed quickly and to resume its natural shape quickly and produce a smooth squishy sensation.

2. The hand exerciser according to claim 1 wherein said inner bladder and said outer bladder are formed of latex.

3. The hand exerciser according to claim 1 wherein said filler material comprises a mass of tiny spheres having a a specific gravity of from about 2.46 g/cc to about 2.49 g/cc.

4. The hand exerciser according to claim 1 wherein said tiny spheres are glass spheres formed of glass oxide (soda-lime glass).

5. A therapeutic resilient hand exerciser comprising:

a mass of tiny spheres having a particle size ranging from about 70 to about 140 U.S. standard mesh (about 0.0083" dia. to about 0.0041" dia.) and having the consistency and appearance of a fine powder;

a resilient inner bladder formed of resilient material surrounding said mass of tiny spheres and having a neck portion extending upwardly therefrom;

a resilient outer bladder formed of resilient material surrounding said inner bladder and having a neck portion extending upwardly therefrom surrounding said inner bladder neck portion;

a thin layer of powder disposed between an exterior surface of said inner bladder and an interior surface of said outer bladder to prevent said surfaces from sticking together and allow relative sliding movement therebetween; and a fastener element crimped around said neck portions to securely seal said bladders; wherein said tiny spheres provide low resistance to relative movement by rolling on each other upon squeezing and releasing pressure on said exerciser, said thin layer of powder providing low friction between said inner and outer bladder surfaces, and the resiliency of said superposed bladders all working in combination allow said exerciser to be compressed quickly and to resume its natural shape quickly due to the resiliency of said superposed bladders and produce a smooth squishy sensation.

* * * * *